US008115796B2

(12) United States Patent
Katogi et al.

(10) Patent No.: US 8,115,796 B2
(45) Date of Patent: Feb. 14, 2012

(54) BELTLESS TANDEM-TYPE IMAGE FORMING APPARATUS

(75) Inventors: Syuichi Katogi, Toyokawa (JP); Shoichi Yoshikawa, Okazaki (JP); Fuminori Moro, Toyokawa (JP); Takayuki Ito, Nagoya (JP); Masashi Kawai, Toyohashi (KR); Noboru Oomoto, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 470 days.

(21) Appl. No.: 12/388,075

(22) Filed: Feb. 18, 2009

(65) Prior Publication Data

US 2009/0302531 A1 Dec. 10, 2009

(30) Foreign Application Priority Data

Jun. 10, 2008 (JP) ..... 2008-151795

(51) Int. Cl.

| | |
|---|---|
| ***B41J 2/435*** | (2006.01) |
| *G03G 9/08* | (2006.01) |
| *G03G 15/00* | (2006.01) |
| *G03G 15/16* | (2006.01) |
| *G03G 15/20* | (2006.01) |
| *G03G 15/01* | (2006.01) |
| *G03G 15/09* | (2006.01) |
| *B41J 2/385* | (2006.01) |
| *B65H 7/02* | (2006.01) |
| *B65H 5/34* | (2006.01) |
| *B65H 5/02* | (2006.01) |
| *B65H 5/04* | (2006.01) |

(52) U.S. Cl. ..... 347/264; 347/154; 399/16; 399/66; 399/68; 399/297; 399/299; 399/301; 399/312; 399/332; 399/394; 399/396; 399/278; 271/265.01; 271/270; 271/272

(58) Field of Classification Search ..... 271/270, 271/272, 265.01; 399/16, 66, 68, 297, 299, 399/301, 312, 332, 394, 396, 278, 302; 347/154, 347/264

See application file for complete search history.

(56) References Cited

U.S. PATENT DOCUMENTS

| | | | | |
|---|---|---|---|---|
| 5,540,426 | A * | 7/1996 | Nakamura et al. | 271/265.01 |
| 7,426,353 | B1 * | 9/2008 | Sakakibara | 399/68 |
| 2008/0264280 | A1 * | 10/2008 | Baggot et al. | 101/248 |

FOREIGN PATENT DOCUMENTS

| | | |
|---|---|---|
| JP | 2007-140055 A | 6/2007 |
| JP | 2008-156062 | 7/2008 |

* cited by examiner

*Primary Examiner* — Laura Martin
*Assistant Examiner* — Jeremy Bishop
(74) *Attorney, Agent, or Firm* — Buchanan Ingersoll & Rooney PC

(57) ABSTRACT

In a beltless tandem-type image forming apparatus, a plurality of pairs of transfer rollers are placed side by side at intervals along a conveying direction of sheets. A control section independently conveys sheets in sequence through nip sections of respective pairs of transfer rollers driven by a driving section while sequentially transferring images formed by an imaging section onto the sheets. Conveying speeds of the respective pairs of transfer rollers controlled by the driving section are gradually decreased for every pair of transfer rollers from an upstream side toward a downstream side along a conveying direction of the sheets, and consequently, a driving period for driving the respective pairs of transfer rollers to convey each sheet is gradually increased for every pair of transfer rollers from the upstream side toward the downstream side along the conveying direction of the sheets.

6 Claims, 7 Drawing Sheets

BELTLESS TANDEM-TYPE IMAGE FORMING APPARATUS

TECHNICAL FIELD

The present invention relates to a beltless tandem-type image forming apparatus. The beltless tandem-type image forming apparatus herein refers to a type of image forming apparatus in which a plurality of pairs of an image carrier roller and an opposed roller which is brought into pressure contact with the image carrier roller are placed side by side at intervals for conveying sheets independently through nip sections formed from the respective pairs so that images formed on the surfaces of the image carrier rollers are sequentially transferred onto the sheets.

BACKGROUND ART

As the tandem-type image forming apparatus, there is known an apparatus (of direct transfer method) in which four image forming means (hereinafter referred to as "image forming units") each including a pair of a photoconductor drum and a roller which is brought into pressure contact with the photoconductor drum (hereinafter referred to as "a pair of transfer rollers") are placed side by side at intervals for sequentially conveying sheets together with a sheet conveying belt through nip sections which are each formed from the pair of transfer rollers so that toner images formed on surfaces of the photoconductor drums by the electrophotographic method are sequentially transferred onto the sheets (see, e.g., JP 2007-140055 A). Typically, the four image forming units are for transferring toner images of four colors: yellow; magenta; cyan; and black, onto the sheets. In view of downsizing the apparatus, the four image forming units are placed in a region shorter than or equal to the length of the conveying direction of one sheet.

Recently, as compared with the typical apparatus, a beltless tandem-type image forming apparatus has been proposed which independently conveys sheets through the nip sections formed from each of the roller pairs without use of the sheet conveying belt for the purpose of enhancing flexibility for placement of each member or achieving cost reduction.

In the beltless tandem-type image forming apparatus, as shown in FIG. 9, each of the image forming units (respectively denoted by alphabetic symbols Y, M, C and K) has an exposure period for exposing the surface of the photoconductor drum and a transfer period for conveying a sheet through a pair of transfer rollers to transfer an image on the sheet, the exposure period and the transfer period being synchronized with each other. The image forming units Y, M, C and K have the same exposure period and the same transfer period (time width expressed by rectangular pulses in FIG. 9). Accordingly, each pair of transfer rollers in the image forming units Y, M, C and K conveys every part of a sheet at the same conveying speed along the conveying direction of the sheet.

However, the conveying speed of each pair of transfer rollers generally varies due to various factors such as variation in diameter of rollers and deflection of rotating shafts. Accordingly, in the beltless tandem-type image forming apparatus, the conveying speeds of the upstream pairs of transfer rollers sometimes become slower than the conveying speeds of the downstream pairs of transfer rollers, which may cause one sheet to be pulled in different directions at the same time. As a result, a problem of image noise such as color drift and transfer shift on the sheet may arise.

SUMMARY OF INVENTION

Accordingly, an object of the present invention is to provide a beltless tandem-type image forming apparatus capable of preventing image noise such as color drift and transfer shift on a sheet from being generated even if the conveying speed varies among respective pairs of transfer rollers.

In order to achieve the object, a beltless tandem-type image forming apparatus according to the present invention, comprises:

a plurality of pairs of transfer rollers made up of an image carrier roller and an opposed roller which is brought into pressure contact with the image carrier roller, a plurality of the pairs of transfer rollers being placed side by side at intervals along a conveying direction of sheets on which an image should be formed;

an imaging section for forming an image on surfaces of the respective image carrier rollers;

a driving section for driving the respective pairs of transfer rollers so that the sheets are conveyed along the conveying direction; and a control section for independently conveying the sheets in sequence through nip sections of the respective pairs of transfer rollers driven by the driving section, while sequentially transferring images formed by the imaging section on the surfaces of the respective image carrier rollers onto the sheets, wherein conveying speeds of the respective pairs of transfer rollers controlled by the driving section are gradually decreased for every pair of transfer rollers from an upstream side toward a downstream side along the conveying direction of the sheets, and consequently, a driving period for driving the respective pairs of transfer rollers to convey each sheet is gradually increased for every pair of transfer rollers from the upstream side toward the downstream side along the conveying direction of the sheets, and wherein the control section performs control so that an imaging period by the imaging section is synchronized with a driving period by the driving section in every pair of transfer rollers.

The phrase, conveying the sheets "independently", refers to conveying the sheets not together with the sheet conveying belt but conveying the sheets only.

The word "conveying speed of a pair of rollers" refers to the conveying speed at which the pair of rollers conveys the sheets.

In view of downsizing the apparatus, the tandem-type image forming apparatus is generally structured so that a plurality of the pairs of transfer rollers are often placed in a region shorter than or equal to the length of the conveying direction of one sheet. Accordingly, at least the pairs of transfer rollers which are adjacent to each other, among a plurality of the pairs of transfer rollers, are to be placed in a region shorter than the length of the conveying direction of the sheets. In such a case, in the image forming apparatus of the invention, deflection is generated on the sheet in the direction vertical to the conveying direction of the sheet depending on a difference in conveying speed between the pairs of transfer rollers which are adjacent to each other in a region between the pairs of transfer rollers adjacent to each other along the conveying direction of the sheets when the sheets are sequentially conveyed through the nip sections composed of the respective pairs of transfer rollers. Therefore, even if the conveying speed of the respective pairs of transfer rollers varies when the sheets are conveyed, it becomes possible to prevent one sheet from being pulled in different direction at the same time. As a result, the problem of image noise such as color drift and transfer shift on the sheet may be prevented from arising.

The conveying speeds of the respective pairs of transfer rollers controlled by the driving section are gradually decreased for every pair of transfer rollers from an upstream side toward a downstream side along the conveying direction of the sheets, and consequently, a driving period for driving the respective pairs of transfer rollers to convey each sheet is gradually increased for every pair of transfer rollers from the upstream side toward the downstream side along the conveying direction of the sheets. If, as in general tandem-type image forming apparatuses, the length of the imaging period by the imaging section is the same among the respective pairs of transfer rollers, the imaging period by the imaging section and the driving period by the driving section become out of synchronization in a certain pair of transfer rollers. Accordingly, the control section performs control so that the imaging period by the imaging section is synchronized with the driving period by the driving section in every pair of transfer rollers. This achieves sufficient image formation on the sheets.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the present invention will be described in details in conjunction with the embodiments with reference to the drawings.

Figure 1:
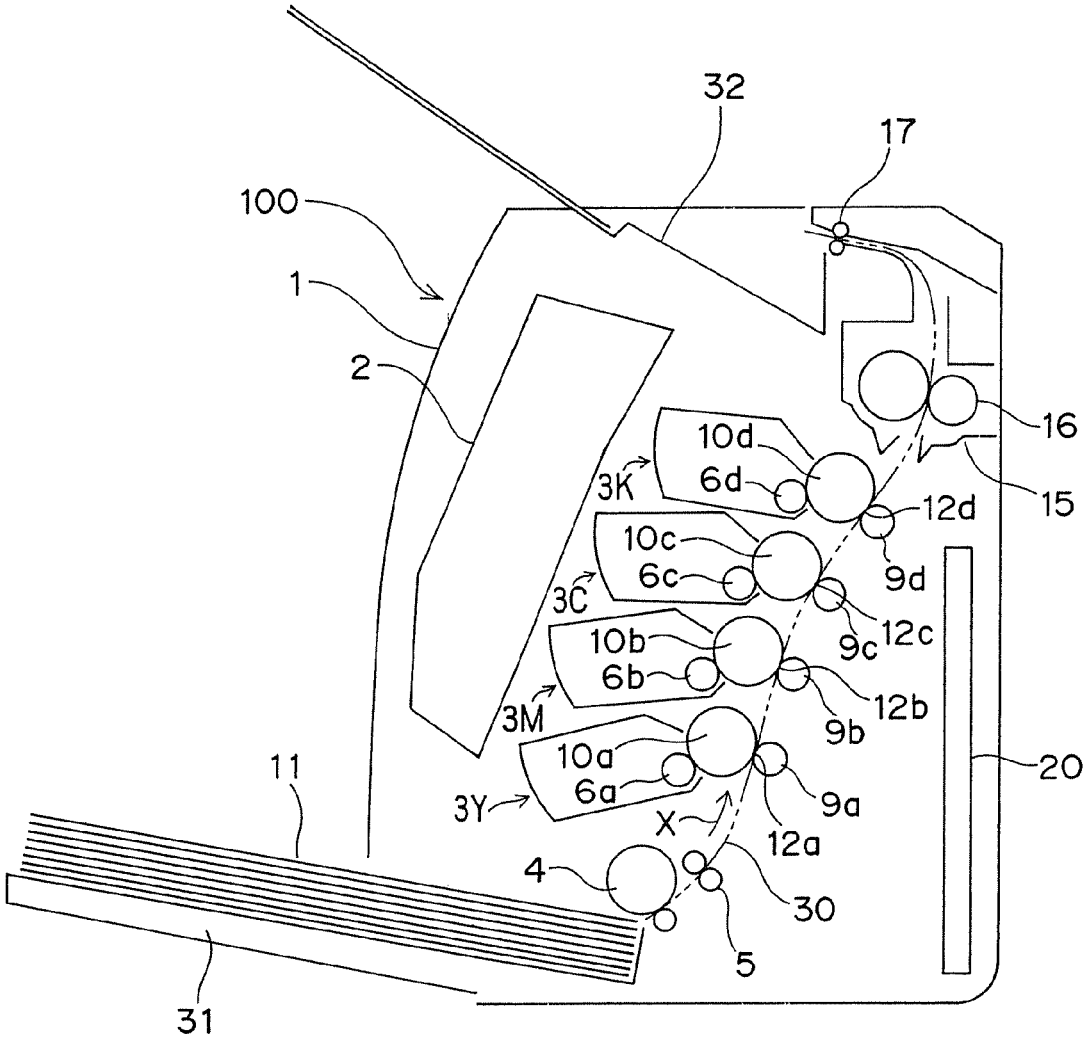
FIG. 1 is a schematic cross sectional structure view of a beltless color tandem-type image forming apparatus in one embodiment of the invention.

FIG. 1 is a schematic cross sectional structure view of a beltless color tandem-type image forming apparatus 100 in one embodiment of the invention. The image forming apparatus 100 is structured so that four cartridge-type image forming units 3Y, 3M, 3C and 3K detachable from a main body casing 1 are placed side by side at intervals in generally the center within the main body casing 1 along a conveying direction X of paper sheets 11 as sheets (a conveying path is shown with a two-dot chain line 30), more specifically from the upstream side (lower side in FIG. 1) to the downstream side (upper side in FIG. 1). The four image forming units 3Y, 3M, 3C and 3K are for transferring toner images of four colors: yellow; magenta; cyan; and black, onto the paper sheets 11 by the electrophotographic method.

In this example, in view of downsizing the apparatus, the four image forming units 3Y, 3M, 3C and 3K are placed in the region shorter than or equal to the length of the conveying direction of one sheet 11 along the conveying direction X. For example, a pitch of the four image forming units 3Y, 3M, 3C and 3K is 70 mm, and the four image forming units 3Y, 3M, 3C and 3K are placed in the range of about 210 mm along the conveying direction X of the paper sheets 11. In this case, the size of the region where the four image forming units 3Y, 3M, 3C, and 3K are placed is equal to the conveying direction size of the paper sheets when the paper sheets are A4 paper sheets defined by JIS (Japanese Industrial Standard), which are conveyed with their longitudinal side being vertical to the conveying direction X (A4Y paper feed). The size of the region where the four image forming units 3Y, 3M, 3C, and 3K are placed is shorter than the conveying direction size of the paper sheets when the paper sheets are A4 paper sheets defined by JIS, which are conveyed with their longitudinal side being parallel to the conveying direction X (A4T paper feed).

Figure 2:
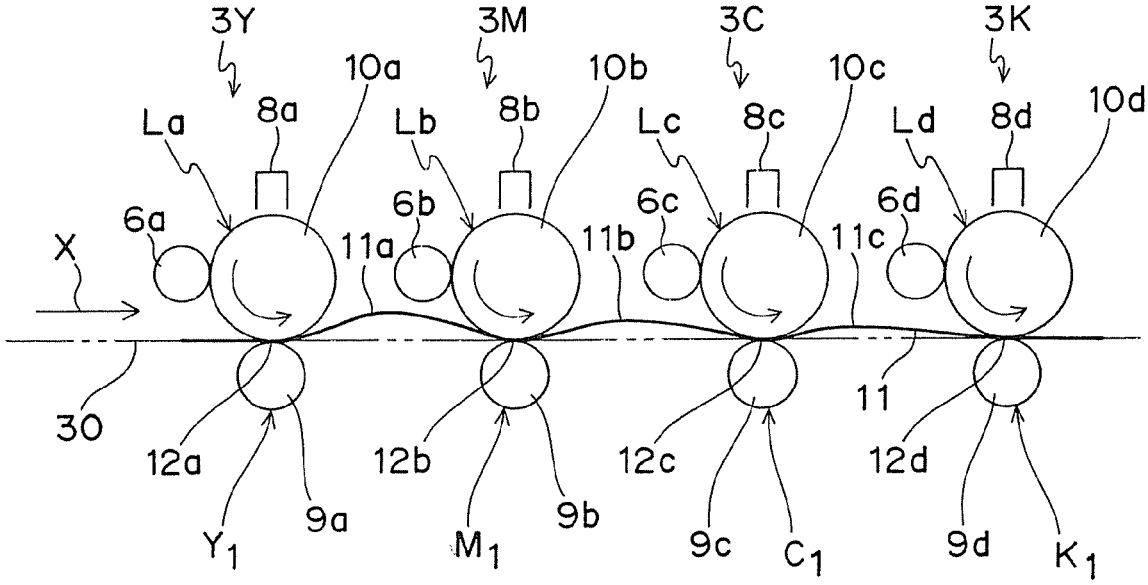
FIG. 2 is a fragmentary enlarged cross sectional view showing an important section of the image forming apparatus.

The respective image forming units 3Y, 3M, 3C and 3K have completely similar configuration except for a difference in toner color that the respective units handle. More specifically, the image forming unit 3Y of yellow color is composed of, for example, a photoconductor drum 10*a* as an image carrier roller which is rotated counterclockwise in the drawing during operation, a charging device 8*a* as a charging section for uniformly charging the surface of the photoconductor drum 10*a*, a semiconductor laser La as an exposure section for forming a latent image on the surface of the photoconductor drum 10*a*, and a developing device 6*a* as a developing section for developing the latent image into a toner image on the surface of the photoconductor drum 10*a* as shown in FIG. 2. These component members 8*a*, La and 6*a* constitute the imaging section. Further, a transfer roller 9*a* as an opposed roller is placed in pressure contact with the photoconductor drum 10*a*. The photoconductor drum 10*a* and the transfer roller 9*a* constitute a pair of transfer rollers $Y_1$.

The image forming unit 3M of magenta color includes a photoconductor drum 10*b*, a charging device 8*b*, a semiconductor laser Lb and a developing device 6*b* as an imaging section as with the image forming unit 3Y of yellow color. A transfer roller 9*b* is placed in pressure contact with the photoconductor drum 10*b*. The photoconductor drum 10*b* and the transfer roller 9*b* constitute a pair of transfer rollers $M_1$.

Similarly, the image forming unit 3C of cyan color also includes a photoconductor drum 10*c*, a charging device 8*c*, a semiconductor laser Lc and a developing device 6*c* as an imaging section. A transfer roller 9*c* is placed in pressure contact with the photoconductor drum 10*c*. The photoconductor drum 10*c* and the transfer roller 9*c* constitute a pair of transfer rollers $C_1$.

The image forming unit 3*k* of black color also includes a photoconductor drum 10*d*, a charging device 8*d*, a semiconductor laser Ld and a developing device 6*d* as an imaging section in a similar manner. A transfer roller 9*d* is placed in pressure contact with the photoconductor drum 10*d*. The photoconductor drum 10*d* and the transfer roller 9*d* constitute a pair of transfer rollers $K_1$.

Figure 4:
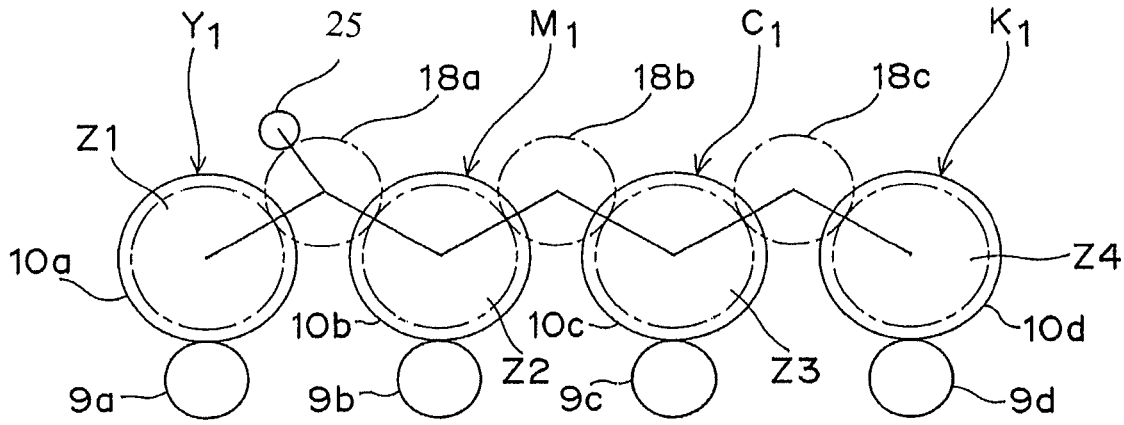
FIG. 4 is a view showing a configuration example of the driving section of the image forming apparatus of FIG. 1.

In this example, as shown in FIG. 4, the respective pairs of transfer rollers $Y_1$, $M_1$, $C_1$ and $K_1$ are driven by a motor 25 and gears 18*a*, 18*b*, 18*c*, Z1, Z2, Z3 and Z4 as a driving section. More specifically, rotation of the motor 25 is transmitted to other gears Z1 and Z2 via the gear 18*a*. The pairs of transfer rollers $Y_1$ and $M_1$ are driven by the gears Z1 and Z2, respectively. Rotation of the gear Z2 is transmitted to the gear Z3 via another gear 18*b*, and the pair of transfer rollers $C_1$ is driven by the gear Z3. Further, rotation of the gear Z3 is transmitted to the gear Z4 via another gear 18*c*, and the pair of transfer rollers $K_1$ is driven by the gear Z4. In the driving section of FIG. 4, the gears 18*a*, 18*b*, and 18*c* have the same number of teeth. Contrary to this, the number of teeth in the gears Z1, Z2, Z3 and Z4 gradually increases in this order. As a result, the conveying speeds to convey the paper sheets 11 by the respective pairs of transfer rollers $Y_1$, $M_1$, $C_1$ and $K_1$ are gradually decreased for every pair of transfer rollers from the upstream side toward the downstream side along the conveying direction X.

In order to convey the paper sheets 11, the driving section drives the photoconductor drums 10*a*, 10*b*, 10*c* and 10*d* which constitute the respective pairs of transfer rollers $Y_1$, $M_1$, $C_1$ and $K_1$, and the transfer rollers 9*a*, 9*b*, 9*c* and 9*d* rotate following after the rotation of the photoconductor drums 10*a*, 10*b*, 10*c* and 10*d*. In the thus-structured driving section, only the photoconductor drums 10*a*, 10*b*, 10*c* and 10*d* which constitutes the respective pairs of transfer rollers $Y_1$, $M_1$, $C_1$ and $K_1$ should be driven in order to convey the paper sheets 11, and therefore as compared with the case where both the photoconductor drum and the transfer roller are driven, the configuration of the driving section is simplified.

As shown in FIG. 1, a paper feed tray 31 for storing the paper sheets 11 is detachably mounted on the lower left section (in FIG. 1 and so forth) inside the main body casing 1. A main body 2 of the aforementioned semiconductor lasers La, Lb, Lc and Ld is provided in the upper left section within the main body casing 1. A fixing unit 15 housing a pair of fixing rollers 16 for fixing toner images onto the paper sheets 11 is provided in the upper right section within the main body casing 1. A control section 20 for controlling the operation of the entire image forming apparatus 100 is provided in the lower right section within the main body casing 1.

At the time of image formation, the paper sheets 11 are taken out one by one from the paper cassette 31 by a pair of feed rollers 4 under control by the control section 20 and are sent out to a conveying path 30 by a pair of conveying rollers 5. The paper sheet 11 sent out to the conveying path 30 is sent into the nip section (between the photoconductor drum and the transfer roller) of the pair of transfer rollers $Y_1$ placed on the most upstream side among the four pairs of transfer rollers. The paper sheet 11 is then conveyed through the nip sections of the respective pairs of transfer rollers $Y_1$, $M_1$, $C_1$ and $K_1$ driven by the driving section independently, i.e., by a beltless conveyance method.

Under control by the control section 20, the surfaces of the photoconductor drums 10*a* 10*b*, 10*c* and 10*d* are uniformly charged by the charging devices 8*a*, 8*b*, 8*c* and 8*d* in each of the image forming units 3Y, 3M, 3C and 3K, and are further exposed by the semiconductor lasers La, Lb, Lc and Ld to form latent images thereon. Next, a predetermined developing bias is applied to the developing devices 6*a*, 6*b*, 6*c* and 6*d*, by which the toner included in a developer flies, and latent images are visualized (developed). Consequently, toner images are formed on the surfaces of the respective photoconductor drums 10*a* 10*b*, 10*c* and 10*d*.

The toner images formed on the surfaces of the respective photoconductor drums 10*a*, 10*b*, 10*c* and 10*d* are transferred onto paper sheets 11 when the paper sheets 11 are sequentially conveyed through the nip sections 12*a*, 12*b*, 12*c* and 12*d* of the respective pairs of transfer rollers $Y_1$, $M_1$, $C_1$ and $K_1$. The paper sheet 11 with toner images transferred thereon is conveyed through the pair of fixing rollers 16 of the fixing unit 15, by which toner images are fixed to the paper sheet 11. The paper sheet 11 with the toner images fixed thereto is then discharged by a paper ejecting roller 17 into a paper ejection tray section 32 provided on the upper surface of the main body casing 1.

As described before, the conveying speeds of the respective pairs of transfer rollers $Y_1$, $M_1$, $C_1$ and $K_1$ for conveying the paper sheets 11 are gradually decreased for every pair of transfer rollers from the upstream side toward the downstream side along the conveying direction X. Accordingly, as shown in FIG. 2, when the paper sheets 11 are conveyed sequentially through the nip sections formed from the respective pairs of transfer rollers $Y_1$, $M_1$, $C_1$ and $K_1$, deflections 11*a*, 11*b* and 11*c* are generated on the paper sheet 11 in the direction vertical to the conveying direction X, depending on a difference in conveying speed between the pairs of transfer rollers which are adjacent to each other, in the regions between the pairs of transfer rollers $Y_1$ and $M_1$, $M_1$ and $C_1$, and $C_1$ and $K_1$, which are adjacent to each other along the conveying direction X of the paper sheets 11. Therefore, even if the conveying speeds of the respective pairs of transfer rollers $Y_1$, $M_1$, $C_1$ and $K_1$ vary when the paper sheets 11 are conveyed, it becomes possible to prevent one paper sheet 11 from being pulled in different direction at the same time. As a result, it becomes possible to prevent the problem of image noise such as color drift and transfer shift on the paper sheet 11 may be prevented from arising.

Description is now given with concrete numerical values. It is assumed that the diameter of the photoconductor drums 10*a*, 10*b*, 10*c* and 10*d* would be 30 mm, the diameter tolerance would be ±0.03 mm, the diameter of the respective transfer rollers 9*a*, 9*b*, 9*c* and 9*d* would be 18.7 mm, and the diameter tolerance would be ±0.1 mm. In this case, the deflection of the respective transfer rollers 9*a*, 9*b*, 9*c* and 9*d* (shaft displacement) is assumed to be 0.1 mm on an average and 0.15 mm at a maximum. Based on the ratio of a maximum deflection value to the diameter of the transfer rollers (0.15 mm/18.7 mm), the variation of the conveying speeds in the pairs of transfer rollers $Y_1$, $M_1$, $C_1$ and $K_1$ which are adjacent to each other is estimated to be about 0.8%. Accordingly, the number of teeth of the gears Z1, Z2, Z3 and Z4 in the driving section is set to be gradually increased so that the conveying speeds of the pairs of transfer rollers are decreased from the upstream side toward the downstream side along the conveying direction X. A conveying speed difference of 1% is provided to every pair of transfer rollers $Y_1$, $M_1$, $C_1$ and $K_1$. For example, when the conveying speed of the paper sheets is about 144 mm/s (millimeter per second), the target conveying speed of an upstream pair of transfer rollers, out of the pairs of transfer roller which are adjacent to each other, is set to 144.144 mm/s, while the target conveying speed of a downstream pair of transfer rollers is set to 144.000 mm/s, respectively. Accordingly, even if the conveying speeds of the respective pairs of transfer rollers $Y_1$, $M_1$, $C_1$ and $K_1$ have variation (of about 0.8%), the effect of preventing one paper sheet 11 from being pulled in different directions at the same time can be achieved.

Figure 6:
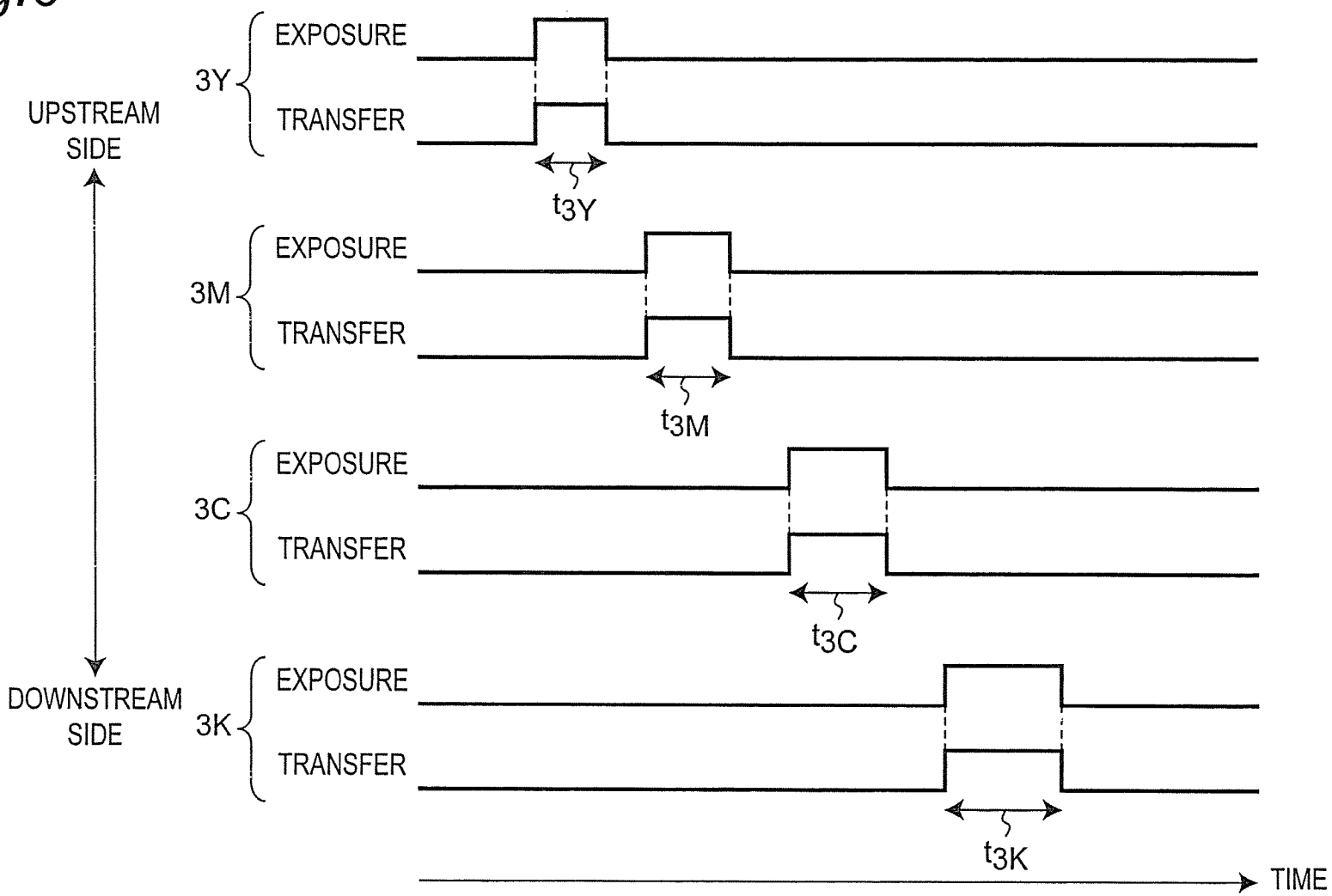
FIG. 6 is a view showing an operation timing of the image forming apparatus of FIG. 1.

It is to be noted that the conveying speeds of the respective pairs of transfer rollers $Y_1$, $M_1$, $C_1$ and $K_1$ by the driving section (FIG. 4) are gradually decreased for every pairs of transfer rollers $Y_1$, $M_1$, $C_1$ and $K_1$ from the upstream side toward the downstream side along the conveying direction X of the paper sheets 11. Consequently, in order to convey each of the paper sheets 11, the driving periods ("transfer" pulse periods t3Y, t3M, t3C, t3K in FIG. 6) for driving the respective pairs of transfer rollers $Y_1$, $M_1$, $C_1$ and $K_1$ are gradually increased for every image forming units 3Y, 3M and 3C and 3K (i.e., the respective pairs of transfer rollers $Y_1$, $M_1$, $C_1$ and $K_1$) from the upstream side toward the downstream side along the conveying direction X of the paper sheets 11. If, as in general tandem-type image forming apparatuses, the length of the imaging period by the imaging section is the same among the respective pairs of transfer rollers $Y_1$, $M_1$, $C_1$ and $K_1$, then the imaging period by the imaging section and the driving period by the driving section become out of synchronization in a certain pair of transfer rollers $Y_1$, $M_1$, $C_1$ and $K_1$. Accordingly, as shown in FIG. 6, the control section 20 performs control so that the imaging periods ("exposure" pulse periods in FIG. 6) by the imaging section are synchronized with the driving periods t3Y, t3M, t3C, t3K for every pair of transfer rollers $Y_1$, $M_1$, $C_1$ and $K_1$. This achieves sufficient image formation on the paper sheets 11.

Figure 5:
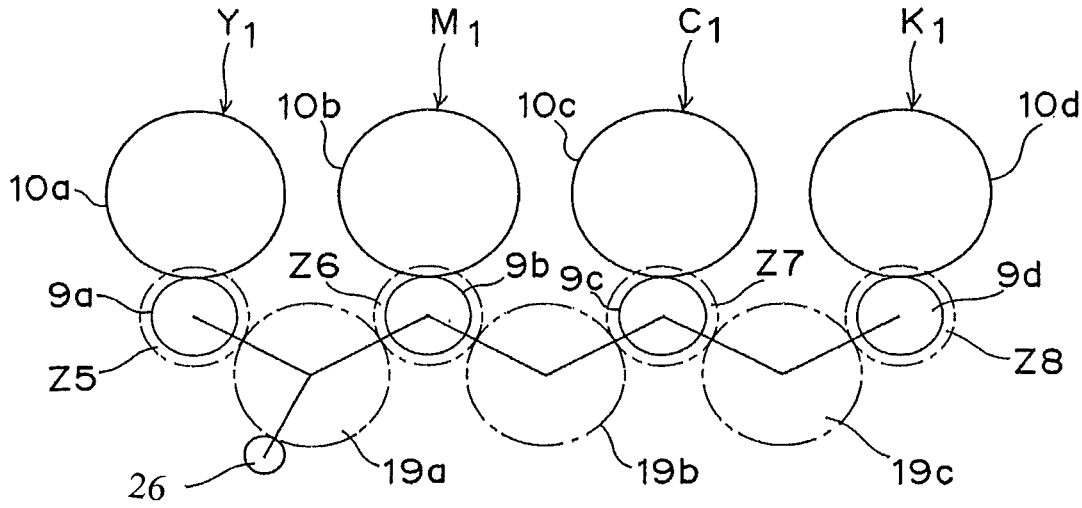
FIG. 5 is a view showing another configuration example of the driving section of the image forming apparatus of FIG. 1.

In this example, as shown in FIG. 4, in order to convey the paper sheets 11, the driving section drives the photoconductor drums 10*a*, 10*b*, 10*c* and 10*d* which constitute the respective pairs of transfer rollers $Y_1$, $M_1$, $C_1$ and $K_1$, and the transfer rollers 9*a*, 9*b*, 9*c* and 9*d* rotate following after the rotation of the photoconductor drums 10*a*, 10*b*, 10*c* and 10*d*. However, the present invention is not limited to this arrangement. As shown in FIG. 5 for example, in order to convey the paper sheets 11, the driving section may drive the transfer rollers 9*a*, 9*b*, 9*c* and 9*d* which constitute the respective pairs of transfer rollers $Y_1$, $M_1$, $C_1$ and $K_1$, and the photoconductor drums 10*a*, 10*b*, 10*c* and 10*d* may rotate following after the rotation of the transfer rollers 9*a*, 9*b*, 9*c* and 9*d*. In the thus-structured driving section, only the transfer rollers 9*a*, 9*b*, 9*c* and 9*d* which constitute the respective pairs of transfer rollers $Y_1$, $M_1$, $C_1$ and $K_1$ should be driven for conveying the paper sheets 11, and therefore as compared with the case where both the photoconductor drum and the transfer roller are driven, the configuration of the driving section is simplified.

In this example in FIG. 5, the respective pairs of transfer rollers $Y_1$, $M_1$, $C_1$ and $K_1$ are driven by a motor 26 and gears 19*a*, 19*b*, 19*c*, Z5, Z6, Z7 and Z8 as a driving section. More specifically, rotation of the motor 25 is transmitted to other gears Z5 and Z6 via the gear 19*a*. The pairs of transfer rollers $Y_1$ and $M_1$ are driven by the gears Z5 and Z6, respectively. Rotation of the gear Z6 is transmitted to the gear Z7 via another gear 19*b*, and the pair of transfer rollers $C_1$ is driven by the gear Z7. Further, rotation of the gear Z7 is transmitted to the gear Z8 via another gear 19*c*, and the pair of transfer rollers $K_1$ is driven by the gear Z8. In the driving section of FIG. 5, the gears 19*a*, 19*b*, and 19*c* have the same number of teeth. Contrary to this, the number of teeth in the gears Z5, Z6, Z7 and Z8 gradually increases in this order. As a result, the conveying speeds to convey the paper sheet 11 by the respective pairs of transfer rollers $Y_1$, $M_1$, $C_1$ and $K_1$ are gradually decreased for every pair of transfer rollers from the upstream side toward the downstream side along the conveying direction X.

If the deflections 11*a*, 11*b* and 11*c* on the paper sheet 11 are too small, variation in the conveying speed of the respective pairs of transfer rollers $Y_1$, $M_1$, $C_1$ and $K_1$ (about 0.8%), if exist, cannot be absorbed, and this may cause one paper sheet 11 from being pulled in different directions at the same time. If the deflections 11*a*, 11, and 11*c* on the paper sheet 11 are too large, the paper sheet 11 unnecessarily comes closer to the photoconductor drums 10*a*, 10*b*, 10*c* and 10*d* in a region other than the nip sections, as a result of which the toner images transferred on the paper sheet 11 may fly to the surfaces of the photoconductor drums 10*a*, 10*b*, 10*c* and 10*d* and thereby cause image noise. Therefore, in this example, a target range appropriate for the deflections 11*a*, 11*b* and 11*c* on the paper sheet 11 is predetermined.

It is to be noted that the size of the deflections 11*a*, 11*b* and 11*c* may be managed as a distance of the paper sheet 11 which is curved and displaced from the conveying path 30. For example, the size is set as in the range of 1.0 mm to 6.0 mm, more preferably as in the range of 2.0 mm to 5.0 mm.

Figure 7:
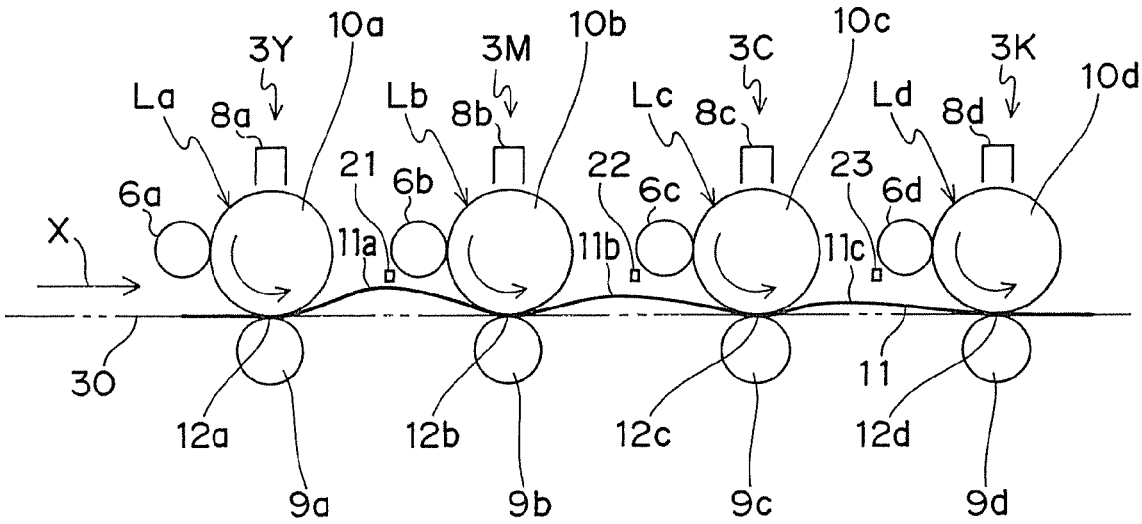
FIG. 7 is a fragmentary cross sectional structure view of a modified example of the image forming apparatus.

FIG. 7 is a fragmentary cross section structure of a modified example of the beltless color tandem-type image forming apparatus 100. In this example, in the regions between the pairs of transfer rollers $Y_1$ and $M_1$, $M_1$ and $C_1$, and $C_1$ and $K_1$, which are adjacent to each other along the conveying direction X of the paper sheets 11, paper sensors 21, 22 and 23 as a deflection detection section are respectively provided and faced with the conveying path 30. The respective pairs of transfer rollers $Y_1$, $M_1$, $C_1$ and $K_1$ are to be driven independently of each other by unshown driving sections (motors). In this example, the control section 20 functions as a deflection control section and performs the following operation.

Figure 8:
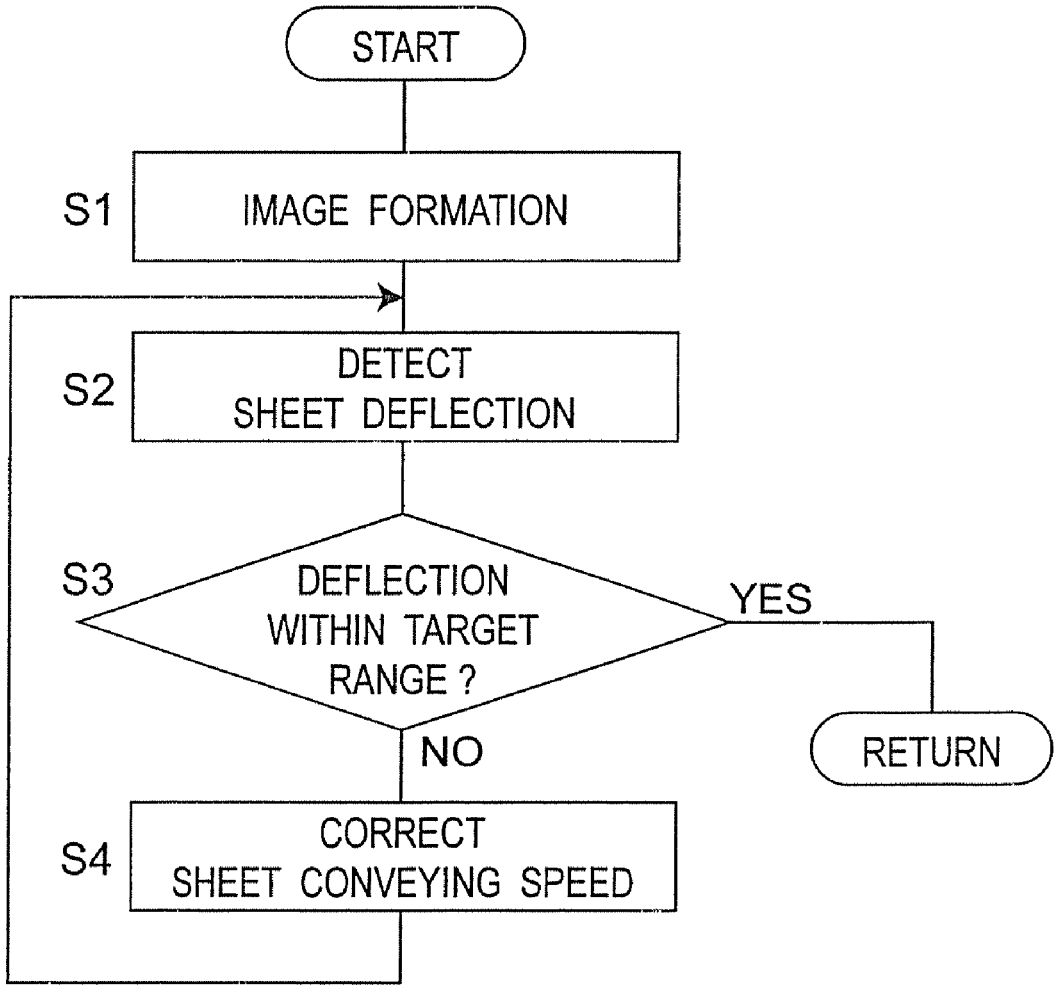
FIG. 8 is a view showing flows of control of the image forming apparatus of FIG. 7.
Figure 9:
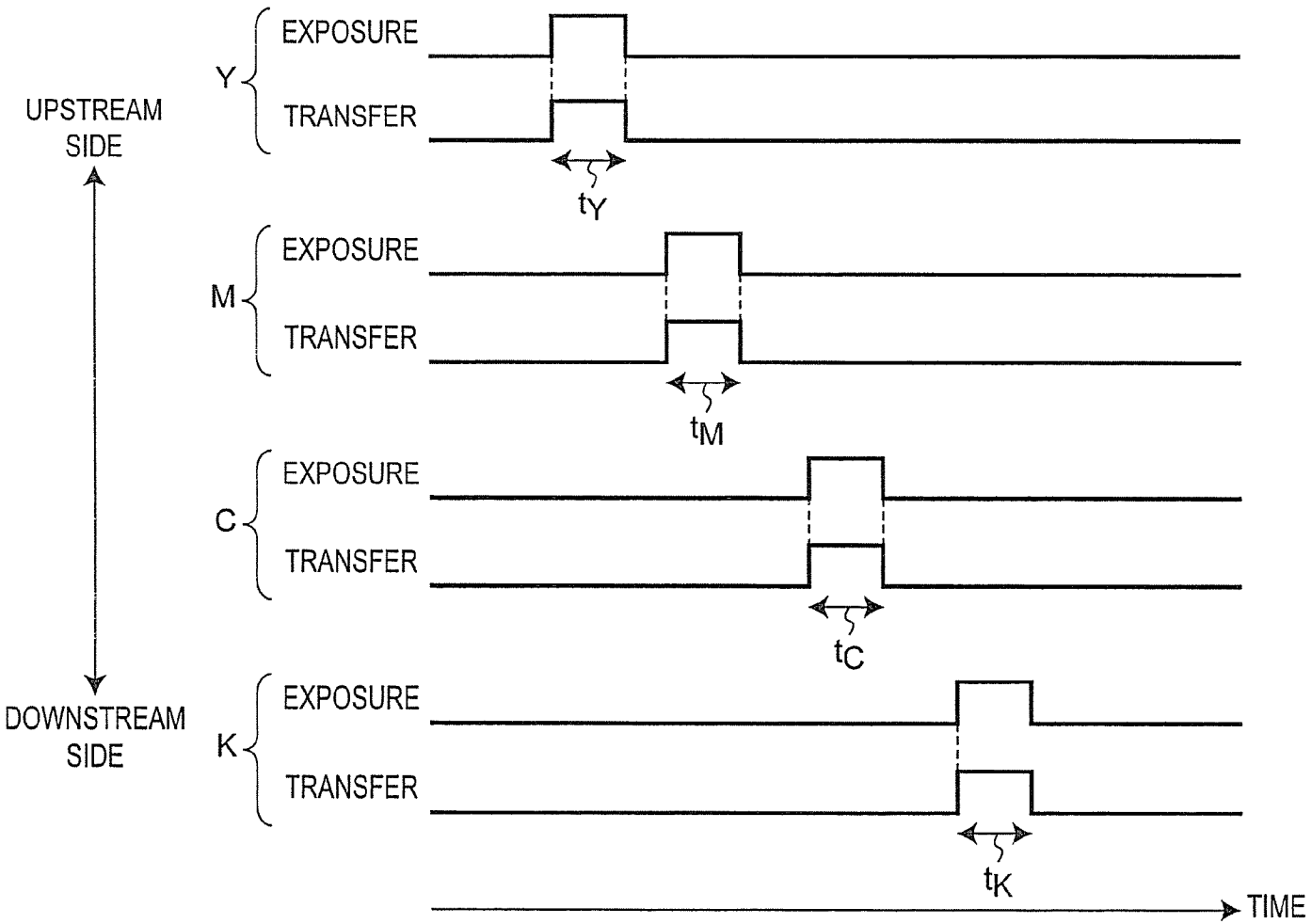
Fig.9 RELATED ART
FIG. 9 is a view showing an operation timing of a beltless color tandem-type image forming apparatus proposed as a related art.

First, as shown in FIG. 8, image formation is started (Step S1) and paper sheets 11 are conveyed sequentially through the nip sections of the respective pairs of transfer rollers $Y_1$, $M_1$, $C_1$ and $K_1$. In this case, the initial conveying speeds of the respective pairs of transfer rollers $Y_1$, $M_1$, $C_1$ and $K_1$, are so set that the conveying speeds of the pairs of transfer rollers are gradually decreased from the upstream side toward the downstream side along the conveying direction X. Typically, a conveying speed difference of 1% is provided to every pair of transfer rollers $Y_1$, $M_1$, $C_1$ and $K_1$.

Next, the deflections 11*a*, 11*b* and 11*c* of the paper sheet 11 which passes through the region facing the paper sensors 21, 22 and 23 are detected (Step S2). The outputs of the paper sensors 21, 22 and 23 are sent to the control section 20.

Next, the control section 20 functions as a deflection control section and determines whether or not the deflections 11*a*, 11*b* and 11*c* of the paper sheet 11 detected by the paper sensors 21, 22 and 23 are in a predetermined target range (Step S3). If the deflections 11*a*, 11*b* and 11*c* are in the target range (YES in Step S3), then the procedure is returned to the processing for image formation. If the deflections 11*a*, 11*b* and 11*c* are not in the target range (NO in Step S3), then the conveying speeds of the respective pairs of transfer rollers $Y_1$, $M_1$, $C_1$ and $K_1$ are corrected so that the deflections 11*a*, 11*b* and 11*c* of the paper sheet (sheet) 11 may be in the target range. The correction may be achieved by changing the conveying speeds (referred to as $vY_1$, $vM_1$, $vC_1$ and $vK_1$, respectively) of the respective pairs of transfer rollers $Y_1$, $M_1$, $C_1$ and $K_1$ independently of each other, or by increasing or decreasing the conveying speeds while keeping the ratio of the conveying speeds of the respective pairs of transfer rollers $Y_1$, $M_1$, $C_1$ and $K_1$ ($vY_1/vM_1$, $vM_1/vC_1$ and $vC_1/vK_1$) equal.

Thus, when the control section 20 controls the deflections 11*a*, 11*b* and 11*c* of the paper sheet 11 to be in the target range, it becomes possible to certainly prevent the paper sheet 11 from being pulled in different directions at the same time. It also becomes possible to prevent image noise from being generated on the paper sheet because of too large deflection.

It is to be noted that typical values of the deflections 11*a*, 11*b* and 11*c* of the paper sheet 11 are different, like 4.7 mm, 3.8 mm and 2.7 mm depending on the regions. Therefore, the target range of deflection may be variably set depending on the regions.

Figure 3:
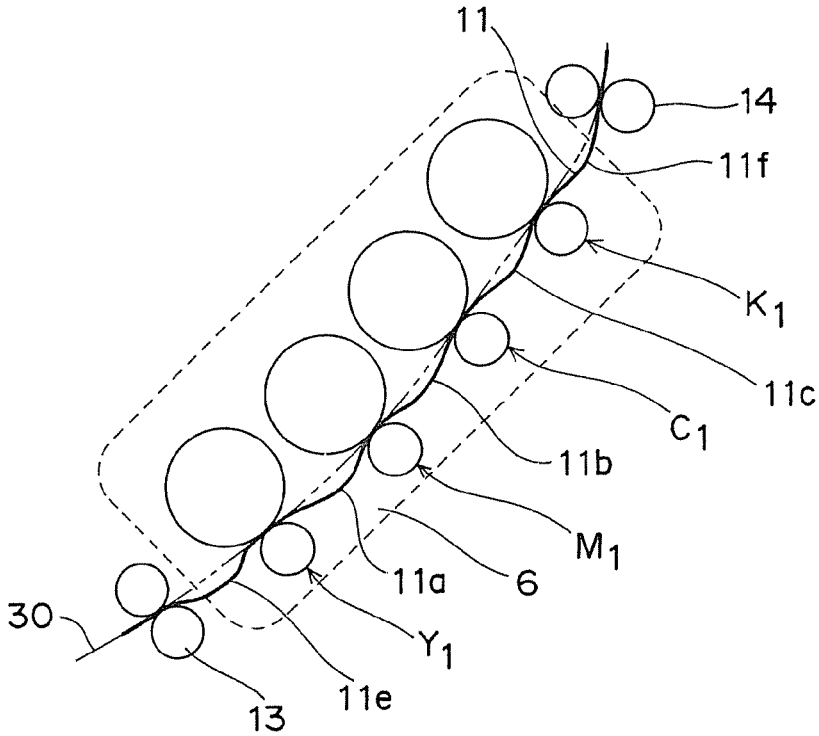
FIG. 3 is a fragmentary cross sectional structure view of a modified example of the image forming apparatus.

FIG. 3 is a fragmentary cross section structure of another modified example of the beltless color tandem-type image forming apparatus 100. In this example, a first pair of conveying rollers 13 and a second pair of conveying roller 14 for respectively conveying the paper sheets 11 are respectively placed upstream and downstream of the four pairs of the transfer rollers $Y_1$, $M_1$, $C_1$ and $K_1$ along the conveying direction X of the paper sheets 11. The conveying speed of the first pair of conveying rollers 13 is set to be faster than the conveying speed of a pair of transfer rollers placed on the most upstream side among the four pairs of transfer rollers $Y_1$, $M_1$, $C_1$ and $K_1$, while the conveying speed of the second pair of conveying rollers 14 is set to be slower than the conveying speed of a pair of transfer rollers placed on the most downstream side among the four pairs of transfer rollers $Y_1$, $M_1$, $C_1$ and $K_1$.

In this example, when one paper sheet 11 is conveyed over the first pair of conveying rollers 13 and the pair of transfer rollers $Y_1$, a deflection 11*e* is generated on the paper sheet 11 in the direction vertical to the conveying direction X depending on a difference in conveying speed between the pairs of rollers 13 and $Y_1$. When one paper sheet 11 is conveyed over the pair of the transfer rollers $K_1$ and the second pair of conveying rollers 14, a deflection 11*f* is generated on the paper sheet 11 in the direction vertical to the conveying direction X of the paper sheet 11 depending on a difference in conveying speed between the pairs of rollers $K_1$ and 14. Therefore, it becomes possible to prevent the paper sheet 11 from being pulled in different directions at the same time. As a result, it becomes possible to prevent the problem of image noise such as color drift and transfer shift on the paper sheet 11 from arising.

In each of the aforementioned examples, the four image forming units 3Y, 3M, 3C and 3K are placed in the region shorter than or equal to the length of the conveying direction of one sheet 11 along the conveying direction X. However, the present invention is not limited to this arrangement. As long as at least the pairs of transfer rollers $Y_1$, $M_1$, $C_1$ and $K_1$ which are adjacent to each other among a plurality of pairs of transfer rollers $Y_1$, $M_1$, $C_1$ and $K_1$ are placed in the region shorter than the length of the conveying direction X of one paper sheet 11, the invention may be applied.

In each of the aforementioned examples, the invention is applied to the electrophotographic image forming apparatus. Without being limited to the apparatus, the invention may also be applied to the image forming apparatuses employing other methods other than the electrophotographic method.

The invention may widely be applied not only to the image forming apparatuses having four pairs of transfer rollers but also to image forming apparatuses having a plurality of pairs of transfer rollers such as the image forming apparatuses having three pairs of transfer rollers.

As is already described, the beltless tandem-type image forming apparatus according to the present invention, comprises:

a plurality of pairs of transfer rollers made up of an image carrier roller and an opposed roller which is brought into pressure contact with the image carrier roller, a plurality of the pairs of transfer rollers being placed side by side at intervals along a conveying direction of sheets on which an image should be formed;

an imaging section for forming an image on surfaces of the respective image carrier rollers;

a driving section for driving the respective pairs of transfer rollers so that the sheets are conveyed along the conveying direction; and a control section for independently conveying the sheets in sequence through nip sections of the respective pairs of transfer rollers driven by the driving section, while sequentially transferring images formed by the imaging section on the surfaces of the respective image carrier rollers onto the sheets, wherein conveying speeds of the respective pairs of transfer rollers controlled by the driving section are gradually decreased for every pair of transfer rollers from an upstream side toward a downstream side along the conveying direction of the sheets, and consequently, a driving period for driving the respective pairs of transfer rollers to convey each sheet is gradually increased for every pair of transfer rollers from the upstream side toward the downstream side along the conveying direction of the sheets, and wherein the control section performs control so that an imaging period by the imaging section is synchronized with a driving period by the driving section in every pair of transfer rollers.

It is preferable that the image carrier roller is constituted of a photoconductor drum, and that the imaging section includes a charging section for uniformly charging the surface of each of the photoconductor drum, an exposure section for forming a latent image on the surface of each of the photoconductor drum, a developing section for developing the latent image on the surface of each of the photoconductor drum into a toner image, and a fixing section for fixing the toner image transferred onto the sheet to the sheet. Thus, image formation by the electrophotographic method is performed.

One embodiment of the image forming apparatus comprises:

a deflection detection section for detecting deflection of the sheets generated in a direction vertical to the conveying direction of the sheets in a region between pairs of transfer rollers adjacent to each other along the conveying direction of the sheets when the sheets are sequentially conveyed through the nip sections of the respective pairs of transfer rollers driven by the driving section; and a deflection control section for controlling the conveying speeds of the respective pairs of transfer rollers via the driving section so that the deflection detected by the deflection detection section may lie within a predetermined target range.

In the beltless tandem-type image forming apparatus in this embodiment, the deflection detection section detects deflection of the sheets generated in a direction vertical to the conveying direction of the sheets in a region between pairs of transfer rollers adjacent to each other along the conveying direction of the sheets when the sheets are sequentially conveyed through the nip sections of the respective pairs of transfer rollers driven by the driving section. The deflection control section controls the conveying speeds of the respective pairs of transfer rollers via the driving section so that the deflection detected by the deflection detection section may lie within a predetermined target range. As a result, the deflection generated in the direction vertical to the conveying direction of the sheets is maintained in the target range. Therefore, it becomes possible to certainly prevent the sheet from being pulled in different directions at the same time. If the deflection of the sheet becomes too large, the sheet unnecessarily comes closer to the image carrier rollers in a region other than the nip sections, which results in such a problem that a toner image transferred on the paper sheet 11 may fly to the surface of the image carrier roller. Such a problem can be prevented if the deflection of the sheet is maintained in the target range.

One embodiment of the image forming apparatus comprises:

a first pair of conveying rollers and a second pair of conveying rollers for respectively conveying the sheets respectively placed upstream and downstream of a plurality of the pairs of transfer rollers with respect to the conveying direction of the sheets, wherein a conveying speed of the first pair of conveying rollers is faster than a conveying speed of a pair of transfer rollers placed on a most upstream side among a plurality of the pairs of transfer rollers, and a conveying speed of the second pair of conveying rollers is slower than a conveying speed of a pair of transfer rollers placed on a most downstream side among a plurality of the pairs of transfer rollers.

In the beltless tandem-type image forming apparatus of this embodiment, the conveying speed of the first pair of conveying rollers is faster than the conveying speed of a pair of transfer rollers placed on the most upstream side among a plurality of pairs of the transfer rollers. Therefore, when one sheet is conveyed over the first pair of conveying rollers and the pair of transfer rollers placed on the most upstream side among a plurality of the pairs of transfer rollers, deflection is generated on the sheet in the direction vertical to the conveying direction of the sheet depending on a difference in conveying speed between these pairs of rollers. Therefore, it becomes possible to certainly prevent the sheet from being pulled in different directions at the same time. Moreover, the conveying speed of the second pair of conveying rollers is slower than the conveying speed of a pair of transfer rollers placed on the most downstream side among a plurality of the pairs of transfer rollers. When one sheet is conveyed over a pair of transfer rollers placed on the most downstream side among a plurality of the pairs of transfer rollers and the second pair of conveying roller, deflection on the sheet is generated in the direction vertical to the conveying direction of the sheet depending on a difference in conveying speed between these pairs of rollers. Therefore, it becomes possible to certainly prevent the sheet from being pulled in different directions at the same time. As a result, the problem of image noise such as color drift and transfer shift on the sheet may be prevented from arising.

In one embodiment of the image forming apparatus, the driving section drives the image carrier roller which constitutes each of the pairs of transfer rollers in order to convey the sheets, whereas the opposed roller is driven following after the image carrier roller.

In the beltless tandem-type image forming apparatus in this embodiment, the driving section should drive only the image carrier rollers which constitute the respective pairs of transfer rollers in order to convey the sheets, so that the configuration of the driving section is simplified as compared with the case where both the image carrier roller and the opposed roller are driven.

In one embodiment of the image forming apparatus, the driving section drives the opposed roller which constitutes each of the pairs of transfer rollers in order to convey the sheets, whereas the image carrier roller is driven following after the opposed roller.

In the beltless tandem-type image forming apparatus in this embodiment, the driving section should drive only the opposed rollers which constitute the respective pairs of transfer rollers in order to convey the sheets, so that the configuration of the driving section is simplified as compared with the case where both the image carrier roller and the opposed roller are driven.

In one embodiment of the image forming apparatus, a size of the deflection lies within a range of 1.0 mm to 6.0 mm in a direction vertical to the conveying direction of the sheets.

Although the present invention has been described in detail, it is apparent that numerous modifications may be made. It should be understood that unless departing from the spirit and scope of the invention, such modifications that will be apparent to those skilled in the art are intended to be embraced in the scope of the appended claims.

This application is based on an application No. 2008-151795 filed in Japan, the contents of which are hereby incorporated by reference.

REFERENCE SIGNS LIST

| | |
|---|---|
| 9a, 9b, 9c, 9d | transfer roller |
| 10a, 10b, 10c, 10d | photoconductor drum |
| $Y_1$, $M_1$, $C_1$, $K_1$ | pair of transfer rollers |

CITATION LIST

Patent Literature

JP 2007-140055 A

The invention claimed is:

1. A beltless tandem-type image forming apparatus, comprising:

a plurality of pairs of transfer rollers made up of an image carrier roller and an opposed roller which is brought into pressure contact with the image carrier roller, a plurality of the pairs of transfer rollers being placed side by side at intervals along a conveying direction of sheets on which an image should be formed;

an imaging section for forming an image on surfaces of the respective image carrier rollers;

a driving section for driving the respective pairs of transfer rollers so that the sheets are conveyed along the conveying direction; and a control section for independently conveying the sheets in sequence through nip sections of the respective pairs of transfer rollers driven by the driving section, while sequentially transferring images formed by the imaging section on the surfaces of the respective image carrier rollers onto the sheets, wherein conveying speeds of the respective pairs of transfer rollers controlled by the driving section are gradually decreased for every pair of transfer rollers from an upstream side toward a downstream side along the conveying direction of the sheets, and consequently, a driving period for driving the respective pairs of transfer rollers to convey each sheet is gradually increased for every pair of transfer rollers from the upstream side toward the downstream side along the conveying direction of the sheets, and wherein the control section performs control so that an imaging period by the imaging section is synchronized with a driving period by the driving section in every pair of transfer rollers.

2. The image forming apparatus according to claim 1, comprising:

a deflection detection section for detecting deflection of the sheets generated in a direction vertical to the conveying direction of the sheets in a region between pairs of transfer rollers adjacent to each other along the conveying direction of the sheets when the sheets are sequentially conveyed through the nip sections of the respective pairs of transfer rollers driven by the driving section; and a deflection control section for controlling the conveying speeds of the respective pairs of transfer rollers via the driving section so that the deflection detected by the deflection detection section may lie within a predetermined target range.

3. The image forming apparatus according to claim 1, comprising:

a first pair of conveying rollers and a second pair of conveying rollers for respectively conveying the sheets respectively placed upstream and downstream of a plurality of the pairs of transfer rollers with respect to the conveying direction of the sheets, wherein a conveying speed of the first pair of conveying rollers is faster than a conveying speed of a pair of transfer rollers placed on a most upstream side among a plurality of the pairs of transfer rollers, and a conveying speed of the second pair of conveying rollers is slower than a conveying speed of a pair of transfer rollers placed on a most downstream side among a plurality of the pairs of transfer rollers.

4. The image forming apparatus according to claim 1, wherein the driving section drives the image carrier roller which constitutes each of the pairs of transfer rollers in order to convey the sheets, whereas the opposed roller is driven following after the image carrier roller.

5. The image forming apparatus according to claim 1, wherein the driving section drives the opposed roller which constitutes each of the pairs of transfer rollers in order to convey the sheets, whereas the image carrier roller is driven following after the opposed roller.

6. The image forming apparatus according to claim 2, wherein a size of the deflection lies within a range of 1.0 mm to 6.0 mm in a direction vertical to the conveying direction of the sheets.

* * * * *